United States Patent [19]

Trachte

[11] 4,353,343

[45] Oct. 12, 1982

[54] FUEL INJECTION PUMP FOR INTERNAL COMBUSTION ENGINES

[75] Inventor: Dietrich Trachte, Kornwestheim, Fed. Rep. of Germany

[73] Assignee: Robert Bosch GmbH, Stuttgart, Fed. Rep. of Germany

[21] Appl. No.: 137,034

[22] Filed: Apr. 3, 1980

[30] Foreign Application Priority Data

May 10, 1979 [DE] Fed. Rep. of Germany ..... 2918867

[51] Int. Cl.[3] ..... F02M 59/20

[52] U.S. Cl. ..... 123/502; 123/179 L

[58] Field of Search ..... 123/502, 500, 501, 506, 123/179 L

[56] References Cited

U.S. PATENT DOCUMENTS 2,253,455 8/1941 Eideneier ..... 123/502

2,877,754 3/1959 Roosa ..... 123/502

4,037,574 7/1977 Swift ..... 123/502

FOREIGN PATENT DOCUMENTS 1191844 10/1959 France ..... 123/502

1292608 3/1962 France ..... 123/502

*Primary Examiner*—Charles J. Myhre

*Assistant Examiner*—Carl Stuart Miller

*Attorney, Agent, or Firm*—Edwin E. Greigg

[57] ABSTRACT

A fuel injection pump for internal combustion engines having an injection time adjuster functioning hydraulically is proposed. The adjustment characteristic of the injection time is determined by permitting a discharge of a partial quantity of fuel, this quantity being controllable by means of a relief channel during the relative movement between the adjusting piston and the work cylinder receiving this adjusting piston.

8 Claims, 6 Drawing Figures

FIG.1
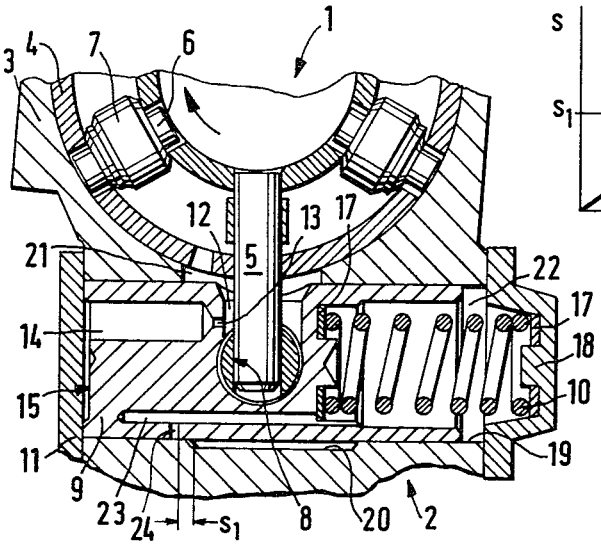
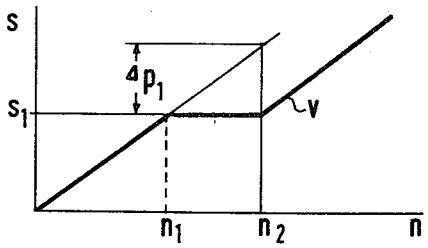
FIG.2
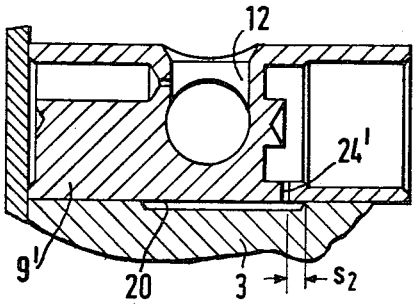
FIG.3
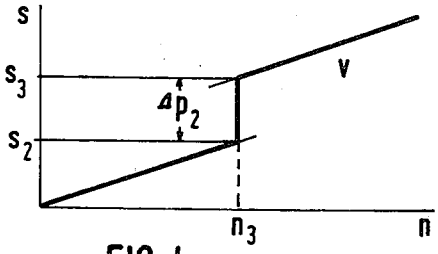
FIG.4
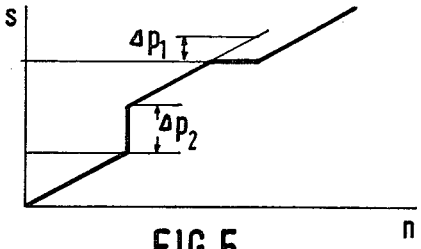
FIG.5
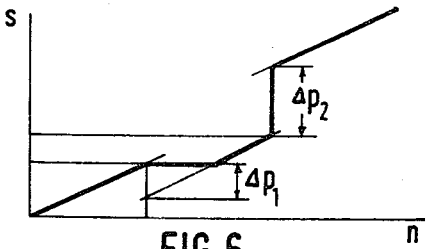
FIG.6

FUEL INJECTION PUMP FOR INTERNAL COMBUSTION ENGINES

BACKGROUND OF THE INVENTION

The invention relates to a fuel injection pump for eternal engines. In a known fuel injection pump, the quantity of fuel to be discharged is controlled via externally actuated valves, but in particular in accordance with temperature, in order to effect a temporary adjustment of injection onset toward "early", particularly when the engine is cold and also at low rpm. A control of this kind, however, is relatively expensive to provide and in its universal applicability it is frequently not necessary, because in most instances it is sufficient for the injection time to be dependent only on the rpm. The problem of adaptation to the injection adjustment characteristic of each engine type can be solved in this known system only relatively expensively, that is, by providing actual value transducers and a control program.

OBJECT AND SUMMARY OF THE INVENTION

The fuel injection pump according to the invention and having the characteristics set forth herein has the advantage over the prior art that an rpm-dependent injection onset adjustment program can be specified in an extremely simple manner. The control according to the invention functions absolutely reliably and can be manufactured extremely inexpensively. Adaptation to the particular type of engine being used is essentially accomplished by means of specifying the control location or the position of the control bore, so that the basic injection adjustment piston or cylinder type, for the purposes of mass production, can be identical and this is of considerable advantage. The position of the bore, which necessarily varies by type, can be programmed into the automatic processor of adjustment pistons of this kind; thus, these changes can also be taken into consideration automatically, after information relating to production quantities has been entered.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a partial cross sectional view through the cam drive of an injection pump having a piston injection adjuster;

FIG. 2 is the function diagram for the apparatus shown in FIG. 1;

FIG. 3 is a partial detail of FIG. 1 also in cross-section, but with a different position for the control bore;

FIG. 4 is the function diagram for the apparatus shown in FIG. 3; and

FIGS. 5 and 6 are diagrams for injection adjustment devices which include the control bores shown in FIG. 1 or FIG. 3 in combined form.

DESCRIPTION OF THE PREFERRED EMBODIMENTS

In the partial cross section of a fuel injection pump shown in FIG. 1 and taken at the level of the cam drive 1, the adjustment of injection onset is effected by means of an injection adjuster 2. In the selected examples, the fuel pumps are distributor-type injection pumps, in which essentially two types of cam drive mechanisms are used. In the first type, the rollers are connected to the pump piston, and the cams are disposed on the ring guided in the housing. In the other type, which is shown here by way of example, the rollers are disposed in the ring guided in the housing and the cams are connected via a cam disc with the pump piston. In either case, the rollers and cams cooperate to provide the drive of the pump piston, and depending on the drive type the rollers or the cams are adjustable relative to one another by means of the injection adjuster 2.

In the exemplary embodiment shown here, a roller ring 4 is guided in a housing 3 of the fuel injection pump and connected by an adjusting piston 5 with the injection adjuster 2. The rollers 7, shown in plan view, are supported via shafts 6 on the roller ring 4. A face cam disc, not shown, but which is well-known in the art is connected with the pump piston and includes a lower working face which then rolls on these rollers 7. In this connection, see co-pending application of Höfer et al., Ser. No. 081,249, now U.S. Pat. No. 4,312,312, filed Oct. 2, 1979and assigned to the assignee of this application. The pump piston and face cam disc rotate in the direction indicated by the arrow. Thus as soon as the roller ring is rotated by only a few degrees counter to this direction indicated by the arrow, supply by the pump piston begins earlier. If the injection quantity is determined not by control of the supply onset but rather by control of the termination of supply, then an adjustment of this kind also means there is a change in the onset of injection into the internal combustion engine.

The adjusting piston 5 of the cam drive mechanism engages a coupling recess 8 of an adjusting piston 9, which is adjustable by means of a hydraulic pressure counter to the force of the restoring spring 10. Accordingly, the farther the piston 9 is displaced against the spring 10, the earlier the injection onset takes place. In the illustrated outset position, the adjusting piston 9 rests against a stop 11 which serves as a cap or cover. The hydraulic pressure serving to effect adjustment is generated in a known manner by a supply pump, not shown, which is integrated with the housing 3 of the fuel injection pump and driven at the rotary speed thereof. The outset pressure of this supply pump is controlled via a pressure control valve, also not shown, in such a manner that it varies in proportion with the rpm; that is, it increases with increasing rpm and drops with decreasing rpm. In the illustrated exemplary embodiment, this supply pump makes its delivery into the housing 3, and fuel which proceeds via appropriate supply bores to the pump work chamber acts as the fluid. In addition, however, the fuel flows via a blind bore 12, which is disposed in the adjusting piston 9 and also receives the adjusting piston 5, via a throttle bore 13 and via a bore 14 to the end face 15 of the adjusting piston 9. When the supply pressure is sufficiently high, the adjusting piston 9 is then displaced counter to the force of the spring 10, as a result of which the onset of injection is displaced toward "early", as described above. The spring 10 is supported via support discs 17 on the adjusting piston 9 on one end and on a housing cap or cover 18 on the other. The caps 11 and 18 close off the ends of a work cylinder 19 of the adjusting piston 9. The portion of the cylinder 19 which includes the spring 10 is relieved of pressure via a channel, not shown.

A groove 20 is provided in the wall of the cylinder 19 in the central area which is covered at all times by the adjusting piston 9 and communicates at all times with a recess 21 of the housing 3 leading to the pump suction chamber. The blind bore 12 is also in constant communication with this recess 21. As a result of the unthrottled communication of the recess 21 with the suction chamber of the injection pump, the rpm-dependent pressure determined by the pressure control valve prevails in the recess 21. A longitudinal blind bore 23, which is open toward the pressure-relieved spring chamber 22, is disposed in the adjusting piston 9 and cooperates via a tapped bore 24 with the groove 20. After the stroke $S_1$ of the adjusting piston 9 has been performed, a connection is established by the blind bore 23 and the tapped bore 24 between the groove 20 and the recess 21 (that is, between the suction chamber of the injection pump to the pressure-relieved spring chamber 22). As a result, a portion of the fuel can flow out of the suction chamber, causing an influence to be exerted on the fuel pressure (suction chamber pressure) acting on the injection adjusting piston.

In the diagrams, the path S of the adjusting piston 9 (on the ordinate) is plotted over the rpm n (on the abscissa). The rpm n, as described above, corresponds to the pressure in the suction chamber, which also acts upon the adjusting piston 9 counter to the force of the spring 10. As shown in the diagram, the course of the adjustment curve V is a straight line until the stroke $S_1$ has been performed. At this point in the stroke, the tapped bore 24 is arranged to overlap the groove 20. The rpm at this point has attained the value $n_1$. Now as soon as the tapped bore 24 is opened, a portion of the fuel flows, pressureless, out of the suction chamber of the injection pump via the blind bore 23 to the spring chamber 22, so that even with a further increase in the rpm the pressure in the suction chamber cannot increase. The overlap of the tapped bore 24 and the groove 20 here acts in the manner of a pressure control, that is, in such a manner that the pressure remains constant even when the rpm is increasing. Now as soon as the tapped bore 24 overlaps the groove 20 fully, and when because of the throttling effect of the tapped bore 24 more fuel is supplied by the supply pump than can flow out via its pressure control valve and the tapped bore 24, then the pressure in the suction chamber rises again, so that at rpm $n_2$ the adjusting piston 9 resumes its stroke. The control by the tapped bore 24 corresponds to a pressure loss of $\Delta p_1$ between rpm $n_1$ and $n_2$. Naturally, instead of a tapped bore 24, a channel with an appropriate cross section at its discharge area, having a rectangular, triangular, or oval shape, can also serve as well. Depending on the embodiment of this discharge area, the path of the curve V could accordingly rise, fall, or even curve in the region between $n_1$ and $n_2$.

In the second exemplary embodiment shown in FIG. 3, the sole change relative to the first exemplary embodiment is the disposition of the tapped bore 24' at a different location. In the illustrated outset position, it overlaps the groove 20, and after the stroke $S_2$ has been performed it is separated from the groove 20 and covered again, so that the discharge of a partial fuel quantity from the suction chamber is halted. As may be seen from the corresponding diagram in FIG. 1, the pressure suddenly varies, at the rpm $n_3$ after the closing of the tapped bore 24', by the value $\Delta p_2$, so that the adjusting piston 9' is abruptly displaced by the distance between $S_2$ and $S_3$. Assuming a virtually inelastic fluid, a continuing pressure increase then ensues, with a displacement of the adjusting piston 9' corresponding to the curve V of FIG. 4. Here, too, as in the previous exemplary embodiment, the course of the curve V can be specified by means of an appropriate embodiment of the tapped bore 24'. If the pressure increase resulting from the closing of the tapped bore 24' at a distance $\Delta S$ is greater than the pressure increase required for this distance, then unstable performance is the result; that is, there is an abrupt jump in pressure. That means that the curve will have a vertical course.

In FIGS. 5 and 6, curves are shown for injection adjusters in which two tapped bores are provided, one each from the exemplary embodiments shown in FIG. 1 and FIG. 2, the bores being either closed or opened in a variable sequence. According to the diagram of FIG. 5, a tapped bore 24' of the type shown in FIG. 2 is first blocked and, after a certain period of interruption of the fuel outflow, a tapped bore 24 of the type shown in FIG. 1 is opened. Here, as well, the course of the curve V can be additionally varied by means of the appropriate embodiment of the tapped bores.

The curve shown in FIG. 6 corresponds to an injection adjustment device in which a tapped bore 24 of the type found in the first exemplary embodiment is first opened and, after a certain period of time, a second tapped bore of the type found in the second exemplary embodiment is blocked. It is also conceivable, given an appropriate embodiment, for a tapped bore first to be opened in the groove 20 and then, after traversing the groove 20, to be closed again.

According to the invention, the groove 20 can also be disposed in the adjusting piston 9 and the bore which cooperates with the groove 20 can extend in the housing 3.

In every case, the reciprocating movement of the adjusting piston 9, in controlling the tapped bore 24, effects a pressure hysteresis, although one pressure is associated with each position of the piston. By the selection of at least one second bore, the surface area associated with the hysteresis can be reduced; for instance, in the case of one second bore, it can be halved.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having a suction chamber and a control device for varying the onset of fuel supply counter to a restoring force by means of an adjusting piston displaceable in a work cylinder by means of fluid pressure, wherein said fluid pressure is controllable by a pressure control valve at least in accordance with rpm and by means of a throttled bore in said adjusting piston permitting a throttled discharge of a partial fuel quantity, characterized in that said adjusting piston and said working cylinder each are provided with annular wall surfaces, said adjusting piston is further provided with a first control location in the annular wall surface thereof, said first control location cooperates with a second control location in the annular wall surface of said working cylinder, one of said control locations is constantly exposed to a pressure relief chamber, the other of said control locations is constantly exposed to said fluid pressure, said second control location comprises a clearance of uniform cross section extending axially of the adjusting piston, whereby communication between the two control locations and thus the throttled discharge of said partial fuel quantity can be controlled by displacing said adjusting piston.

2. A fuel injection pump as defined by claim 1, characterized in that said restoring force comprises a spring and a chamber for receiving said spring, said chamber comprising said pressure relief chamber.

3. A fuel injection pump as defined by claim 1, characterized in that said communication between said control locations is established upon the displacement by a certain distance of the adjusting piston against the restoring spring.

4. A fuel injection pump as defined by claim 1, characterized in that communication between said control locations can be blocked after the displacement by a certain distance of the adjusting piston against the restoring spring.

5. A fuel injection pump as defined by claim 2, characterized in that said adjusting piston is slideably disposed in the work cylinder said second control location comprises a groove in said cylinder, and a relief channel is provided in said adjusting piston for cooperation with said control locations.

6. A fuel injection pump as defined by claim 5, characterized in that said relief channel comprises a bore in said adjusting piston which terminates adjacent to said spring.

7. A fuel injection pump as defined by claim 2, characterized in that said adjusting piston is slideably disposed in the work cylinder, said first control location comprises a blind bore in said adjusting piston.

8. A fuel injection pump as defined by claim 1, characterized in that said pump further includes a cam drive which is under fuel pressure derived from said suction chamber of said pump, and said fuel also serves as said pressure fluid for the adjustment of injection onset which proceeds via a connecting opening disposed between said cam drive and said adjusting piston into said second control location in said work cylinder.

* * * * *